US005306592A

United States Patent [19]

Saha

[11] Patent Number: 5,306,592

[45] Date of Patent: Apr. 26, 1994

[54] METHOD OF PREPARING ELECTROGRAPHIC MAGNETIC CARRIER PARTICLES

[75] Inventor: Bijay S. Saha, Rochester, N.Y.

[73] Assignee: Eastman Kodak Company, Rochester, N.Y.

[21] Appl. No.: 968,925

[22] Filed: Oct. 29, 1992

[51] Int. Cl.[5] ..... G03G 9/107

[52] U.S. Cl. ..... 430/137; 430/106.6; 430/108; 423/594; 252/62.63

[58] Field of Search ..... 430/106.6, 108, 137; 423/594; 252/62.63

[56] References Cited

U.S. PATENT DOCUMENTS

| | | | |
|---|---|---|---|
| 3,053,770 | 9/1962 | Counts | 252/62.63 |
| 3,582,266 | 6/1971 | Sopp et al. . | |
| 3,634,254 | 1/1972 | Micheli | 252/62.63 |
| 3,713,819 | 1/1973 | Hagenbach et al. | 430/120 |
| 3,716,630 | 2/1973 | Shirk | 252/62.63 |
| 3,718,594 | 2/1973 | Miller | 430/137 |
| 3,725,283 | 4/1973 | Fenity | 430/108 |
| 3,795,618 | 3/1974 | Kasper | 430/108 |
| 3,810,973 | 5/1974 | Arendt et al. | 423/594 |
| 3,893,935 | 7/1975 | Jadwin et al. | 430/110 |
| 3,938,992 | 2/1976 | Jadwin et al. | 430/120 |
| 3,941,898 | 3/1976 | Sadamatsu et al | 430/109 |
| 4,025,449 | 5/1977 | Pezzoli et al. | 252/62.63 |
| 4,076,857 | 2/1978 | Kasper et al. | 430/103 |

(List continued on next page.)

FOREIGN PATENT DOCUMENTS

| | | | |
|---|---|---|---|
| 2428004 | 2/1975 | Fed. Rep. of Germany . | |
| 60-71528A | 4/1985 | Japan . | |
| 60-122727A | 7/1985 | Japan . | |
| 62-59531A | 3/1987 | Japan . | |
| 1501065 | 2/1978 | United Kingdom | 430/115 |

OTHER PUBLICATIONS

Lotgering, F. K. and Vromans, P. H. G. M., "Chemical Instability of Metal-Deficient Hexagonal Ferrites with Structure", *Journal of the American Ceramic Society*, vol. 60, No. 9-10 (Feb. 3, 1977), pp. 416-418.

Litsardakis, G. and Samaras, D., "Magnetic Properties of the Sr(Ba)$Zn_xMn_{2-x}$-W Hexagonal Ferrites", *Journal of Magnetism and Magnetic Materials*, (Apr. 20, 1989), pp. 184-188.

(List continued on next page.)

*Primary Examiner*—Roland Martin

*Attorney, Agent, or Firm*—Willard G. Montgomery

[57] ABSTRACT

Carrier particles of substantially uniform particle size and substantially spherical shape comprising hard magnetic ferrite material having a single-phase hexagonal crystalline structure of the formula:

$$MO \bullet (Fe_2O_3)_x \text{ (A)}$$

where M is strontium or barium and x is 5 to 6 suitable for magnetic brush development of electrostatic charge patterns and having a reduced tendency towards early life dusting, are prepared by:

(i) mixing an aqueous solution containing strontium ions and iron (III) ions or barium ions and iron (III) ions in amounts sufficient to provide the strontium ferrite or barium ferrite of formula (A);

(ii) reacting the mixture formed in step (i) with an alkaline aqueous ammonium hydroxide solution having an alkalinity of at least 0.1N to form finely divided co-precipitated particles of strontium hydroxide and iron (III) hydroxide or barium hydroxide and iron (III) hydroxide;

(iii) separating the co-precipitated particles from the aqueous mother liquor;

(iv) washing the resultant co-precipitated particles;

(v) mixing the washed co-precipitated particles obtained from step (iv) with an organic binder and water, as a solvent, to form a slurry;

(vi) spray drying the slurry to obtain green beads of substantially uniform particle size and substantially spherical shape, and (vii) firing the beads at a temperature ranging from approximately 900° C. to 1100° C. for a period of time of from approximately 7 to 10 hours and obtaining magnetic carrier particles of substantially uniform particle size and substantially spherical shape comprising hard magnetic ferrite material having a single-phase, hexagonal crystalline structure of the formula (A).

11 Claims, No Drawings

U.S. PATENT DOCUMENTS

| | | | |
|---|---|---|---|
| 4,124,385 | 11/1978 | O'Horo | 430/108 |
| 4,124,735 | 11/1978 | O'Horo | 430/108 |
| 4,126,437 | 11/1978 | O'Horo | 430/108 |
| 4,336,173 | 6/1982 | Ugelstad | 523/205 |
| 4,341,648 | 7/1982 | Kubo et al. | 252/62.63 |
| 4,394,430 | 7/1983 | Jadwin et al. | 430/110 |
| 4,401,643 | 8/1983 | Hibst et al. | 423/594 |
| 4,407,721 | 10/1983 | Koike et al. | 252/62.59 |
| 4,414,124 | 11/1983 | Endo et al. | 252/62.63 |
| 4,425,250 | 1/1984 | Hibst | 252/62.59 |
| 4,459,378 | 7/1984 | Ugelstad | 523/205 |
| 4,473,029 | 9/1984 | Fritz et al. | 430/122 |
| 4,546,060 | 10/1985 | Miskinis et al. | 430/108 |
| 4,623,603 | 11/1986 | Iimura et al. | 430/108 |
| 4,664,831 | 5/1987 | Hibst et al. | 252/62.59 |
| 4,764,445 | 8/1988 | Miskinis et al. | 430/108 |
| 4,806,265 | 2/1989 | Suzuki et al. | 252/62.63 |
| 4,824,587 | 4/1989 | Kwon et al. | 252/62.55 |
| 4,855,205 | 8/1989 | Saha et al. | 430/106.6 |
| 4,855,206 | 8/1989 | Saha | 430/106.6 |
| 4,957,812 | 9/1990 | Aoki et al. | 428/329 |
| 5,061,586 | 10/1991 | Saha et al. | 430/108 |
| 5,096,797 | 3/1992 | Yoerger | 430/137 X |
| 5,104,761 | 4/1992 | Saha et al. | 430/106.6 |
| 5,106,714 | 4/1992 | Saha et al. | 430/108 |
| 5,135,733 | 8/1992 | Robert et al. | 423/594 |

OTHER PUBLICATIONS

Almodovar, N. Saurez, LLamazaras, J. L. Sanchez, Leccabue, F., Panizzieri, R. and Xue Rong Hwa, "Magnetic Characterization of $SrFe_2Fe_{16}O_{27}$ Ferrite Prepared by Chemical Coprecipitation Method", *Materials Letters,* vol. 8, No. 3.4 (Mar. 8, 1989), pp. 127-131.

Leccabue, F., Panizzieri, R., Garcia, S., Saurez, N., Sanchez, J. L., Ares, O. and Hwa Xue Rong, "Magnetic and Mössbauer Study of Rare-Earth-Substituted M-, W—, and X— Type Hexagonal Ferrite", *Journal of Materials Science,* vol. 25 (1990), pp. 2765-2770.

METHOD OF PREPARING ELECTROGRAPHIC MAGNETIC CARRIER PARTICLES

FIELD OF THE INVENTION

This invention relates to electrography and, more particularly, to a method for improving the performance of carrier particles for use in magnetic brush dry development of electrostatic charge images.

BACKGROUND

The terms "electrography" and "electrographic" as used herein broadly include various processes that involve forming and developing electrostatic charge patterns on surfaces, with or without the use of light. They include electrophotography and other processes. One method of electrographic development is the magnetic brush method which is widely used for dry development in electrophotographic document copying machines. It is disclosed, for example, in U.S. Pat. No. 3,003,462. The method of the present invention is useful in preparing the carrier particles for two-component dry developers used in the magnetic brush method. Such a developer is a mixture of thermoplastic toner particles and magnetic carrier particles, the latter of which may optionally be partially coated with an insulating resin.

In the development station of a copying machine, the two-component developer, which includes the magnetic carrier particles, is attracted to a magnetic brush consisting of stationary magnets surrounded by a rotating cylindrical sleeve or a stationary sleeve surrounding rotating magnets, e.g., as in the patent to Miskinis et al., U.S. Pat. No. 4,546,060. By frictional contact with the carrier particles, the toner particles are triboelectrically charged and cling to the carrier particles, creating bristle-like formations of developer on the magnetic brush sleeve. In developing a charge pattern, the brush is brought close to the charged surface. The oppositely charged toner particles are drawn away from the carrier particles on the magnetic brush by the more strongly charged electrostatic charge pattern, thus developing and making visible the charge pattern.

Although uncoated iron particles have been used as carriers in magnetic brush developers and although the high conductivity of uncoated iron particles is desirable because a conductive magnetic brush serves as a development electrode and improves the development of large solid areas in the image, nevertheless, resincoated carrier particles typically have been preferred. One reason for resin-coating the carrier particles has been to improve the triboelectric charging of the toner particles. When a resin-coated carrier is used, the toner powder acquires an optimally high, net electrical charge because of the frictional contact of the toner particles and the resin coating. The high net charge reduces the amount of toner lost from the developer mix as it is agitated in the magnetic brush apparatus.

Especially useful as the carrier particles in two component developers are strontium and barium ferrites. Ferrites, as used herein, are magnetic oxides containing iron as a major metallic component. The ferrites of strontium and barium referred to herein are the ferrites of strontium and barium having the formula $SrO \bullet 6Fe_2O_3$ and $BaO \bullet 6Fe_2O_3$. These ferrite carriers are disclosed in U.S. Pat. No. 4,546,060 to Miskinis et al and U.S. Pat. No. 4,764,445 to Saha, both of which are incorporated herein by reference. Strontium and barium ferrites, being hard magnetic materials, are desirable as carrier particles. The use of such "hard" magnetic materials which exhibit a coercivity of at least 300 Oersteds when magnetically saturated and an induced magnetic moment of at least 20 EMU/g when in an applied magnetic field of 1000 Oersteds as carrier particles has been found to dramatically increase the speed of development when compared to conventional magnetic carriers made of relatively "soft" magnetic materials such as magnetite, pure iron, ferrite or a form of $Fe_3O_4$ having magnetic coercivities of about 100 gauss or less. The terms "hard" and "soft" when referring to magnetic materials have the generally accepted meaning as indicated on page 18 of *Introduction To Magnetic Materials* by B. D. Cullity, published by Addison-Wesley Publishing Company, 1972.

However, a problem that has been encountered with magnetic ferrite carrier particles containing strontium and barium has been the contamination of the carrier particles with dust or fines in the form of strontium or barium oxide and/or iron (III) oxide, particularly on the surfaces of the carrier particles. When such a carrier is mixed with toner powder to form the two-component developer mixture, this dust deposits on the surfaces of the toner particles and reduces their ability to develop an electrostatic charge due to a reduction in the coercivity and induced magnetic moment caused by such contaminants. An indication of such contamination is toner "throw-off" during the development process. Throw-off is the term used to describe toner particles that separate from the carrier before they are attracted to the more strongly charged photoconductor. This phenomena may also be described as "early life dusting".

Early life dusting or toner throw-off is to be avoided for two reasons. The first reason is the potential damage such airborne toner particles or dust can do to the development apparatus in which the developer is utilized. The second reason is the imaging problems such as unwanted background development of non-image areas or portions of the element due to an incomplete discharge of such non-image areas during exposure and scumming of the electrostatic image bearing elements which are caused by such airborne toner particles. Additionally, such unattached toner particles tend to scum the carrier or pack into its pores. When this happens, the capability of the carrier for triboelectrically charging the toner particles is even further reduced. It is very important, therefore, to eliminate or significantly reduce the problem of early life dusting or toner throw-off.

The source of this contamination is a result of the way in which the ferrite carrier particles have been manufactured in the past.

In the conventional carrier manufacturing process for producing strontium and barium ferrite carrier particles, powders of ferric oxide (i.e., $Fe_2O_3$) and the oxides of barium or strontium or a salt of barium or strontium convertible to the oxide by heat such as the carbonates, sulfates, nitrates or phosphates of barium or strontium are mixed together in a predetermined ratio, typically from about 4 to 6 moles of $Fe_2O_3$ per 1 mole of the metal oxide or metal oxide-forming salt. This mixture of ferrite-forming precursor materials or particles is then mixed with a solution of an organic binder, such as guar gum, and a polar solvent, preferably water, ball milled into a liquid slurry and then spray dried to form unreacted, nonmagnetic, dried green beads. Spray drying is the most commonly used technique to manufacture green beads. This technique is described in K. Masters, "Spray Drying Handbook", George Godwin Limited, London, 1979, which is hereby incorporated by reference. Guar gum is a natural product which has been widely used in industry because it is inexpensive, nontoxic, soluble in water and generally available. It also undergoes nearly complete combustion in the subsequent firing stage, leaving little residue in the magnetic ferrite carrier particles. Upon evaporation, these droplets form individual green beads of substantially uniform particle size and substantially spherical shape.

During the ball milling process, a liquid slurry is produced containing the constituent raw materials. During spray drying, the solvent (e.g., water) in the liquid droplet is evaporated. In the dried droplet, the organic binder acts to bind the constituent ferrite-forming materials or particles together.

In order to prepare the magnetic carrier particles, the qreen beads are subsequently fired at high temperatures, generally ranging from about 900° to 500° C. During the firing process, the individual particulates within the individual green beads react to produce the desired crystallographic phase. Thus, during the firing process, the individual unreacted ferrite-forming precursor components bound in the nonmagnetic green bead react to form the magnetic carrier particles, which, like the green beads are of substantially uniform particle size and substantially spherical shape. The organic binder is degraded and is not present in the magnetic carrier particles. The magnetic character of the carrier particle, that is the coercivity and induced magnetic moment of the carrier particle is controlled primarily by the chemical stoichiometry of the constituting ferrite-forming materials and the processing conditions of reaction time and temperature. For optimum carrier performance, it is important that the chemical composition of the green beads be maintained throughout the spray drying process. The disintegration of green beads can result in chemically heterogeneous green bead particles, which will lead to less than optimum chemical reactions during the firing process and inferior magnetic performance of the final product.

It is realized, however, that this method of forming ferrites, i.e., by mechanically mixing or ball milling the constituent ferrite-forming raw materials together to a fine state of subdivision, does not achieve an intimacy in the pre-fired mixture which is conducive to rapid and complete reaction to compositionally pure strontium or barium ferrites. That is, a high degree of chemical homogenity of the precursor materials in the pre-fired mixture cannot be obtained by the mere mechanical mixing of the ferrite-forming constituent materials so that upon firing of the individual unreacted ferrite-forming precursor components bound in the non-magnetic green beads to form the magnetic carrier particles, a portion of the ferrite-forming materials do not react completely to form carrier particles of pure single-phase strontium or barium ferrite, but instead remain unreacted in the form of unwanted strontium oxide, barium oxide and/or iron (III) oxide which contaminate the carrier particles in the manner previously described herein-above.

SUMMARY OF THE INVENTION

In accordance with the present invention, we have found that reduction in the charging capabilities of such magnetic ferrite carrier particles and hence "early life dusting" or toner "throw-off" can be substantially reduced or substantially eliminated by utilizing a chemical co-precipitation process in which magnetic strontium or barium ferrite carrier particles can be produced which are devoid or substantially devoid of any of the aforedescribed contaminates produced by conventional mechanical mixing processes heretofore used for making hard magnetic strontium and barium ferrite carrier particles.

The electrographic developer carriers which are made by the method of this invention are magnetic carrier particles of substantially uniform particle size and substantially spherical shape which comprise hard magnetic ferrite material having a single-phase hexagonal crystalline structure of the formula:

$$MO \bullet (Fe_2O_3)_x \quad (A)$$

where M is strontium or barium and x is 5 to 6.

The method of this invention comprises introducing into and reacting with an alkaline aqueous ammonium hydroxide solution having an alkalinity of at least 0.1N, an aqueous solution containing either strontium ions and iron (III) ions or barium ions and iron (III) ions in amounts sufficient to provide a strontium ferrite or barium ferrite o formula (A) above.

Upon combination of the solutions, a co-precipitate of finely divided particles of strontium hydroxide and iron (III) hydroxide or barium hydroxide and iron (III) hydroxide :s formed. The co-precipitate so formed is removed from the aqueous mother liquor or liquid portion of the reactants by filtration, for example, washed and then mixed with an organic binder and water, as a solvent, to form a slurry. The slurry is then spray dried to obtain green beads of substantially uniform particle size and substantially spherical shape. The green beads are then fired at a temperature ranging from approximately 900° C. to 1100° C. for a period of time of from approximately 7 to 10 hours to form magnetic carrier particles of substantially uniform particle size and substantially spherical shape comprising hard magnetic single-phase hexagonal crystalline strontium ferrite or barium ferrite devoid or substantially devoid of any undesirable strontium oxide, barium oxide and/or iron (III) oxide contaminants.

By utilizing the chemical co-precipitation process of the present invention, it is possible to achieve an extremely high degree of homogenity of the pre-fired materials. That is, the strontium and iron cations and the barium and iron cations are inherently in closer proximity after co-precipitation than is possible to achieve by the mere mechanical mixing of the iron (III) oxide and the barium or strontium oxide (or salt) precursor powders used in past processes for producing magnetic ferrite carrier particles. This is due to the simultaneous precipitation of the individual iron (III) hydroxide and the strontium hydroxide or iron (III) hydroxide and barium hydroxide whereby a chemical bond is formed among the co-precipitates at the molecular level. That is, mixing of the individual species occurs at the molecular level. This intimacy and homogenity between the ions of strontium and iron or barium and iron prior to solid state reaction during the firing step prevents the formation of undesirable by-products or contaminants, such as strontium oxide, barium oxide and/or iron (III) oxide which are produced by the mechanical mixing methods utilized in the past and which cause the charging capability of the magnetic ferrite carrier particles to be reduced in the manner as previously discussed.

Thus, in one embodiment of the present invention, there is provided a method of producing magnetic carrier particles of substantially uniform particle size and substantially spherical shape comprising hard magnetic ferrite material having a single-phase hexagonal crystalline structure of the formula:

$$MO \bullet (Fe_2O_3)_x \text{ (A)}$$

where M is strontium or barium and x is 5 to 6 suitable for magnetic brush development of electrostatic charge patterns and having a reduced tendency towards early life dusting, which method comprises:

(i) mixing an aqueous solution containing strontium ions and iron (III) ions or barium ions and iron (III) ions in amounts sufficient to provide the strontium ferrite or barium ferrite of formula (A);

(ii) reacting the mixture formed in step (i) with an alkaline aqueous ammonium hydroxide solution having an alkalinity of at least 0.1N to form finely divided co-precipitated particles of strontium hydroxide and iron (III) hydroxide or barium hydroxide and iron (III) hydroxide;

(iii) separating the co-precipitated particles from the aqueous mother liquor;

(iv) washing the resultant co-precipitated particles;

(v) mixing the washed co-precipitated particles obtained from step (iv) with an organic binder and water, as a solvent, to form a slurry;

(vi) spray drying the slurry to obtain green beads of substantially uniform particle size and substantially spherical shape, and (vii) firing the beads at a temperature ranging from approximately 900° to 1100° C. for a period of time of from approximately 7 to 10 hours to obtain magnetic carrier particles of substantially uniform particle size and substantially spherical shape comprising hard magnetic ferrite material having a single-phase, hexagonal crystalline structure of the formula:

$$MO \bullet (Fe_2O_3)_x \text{ (A)}$$

where M is strontium or barium and x is 5 to 6.

In another embodiment of the invention, there is provided an electrographic developer mixture suitable for magnetic brush development of electrostatic charge patterns having a reduced tendency towards early life dusting comprising finely-divided charged toner particles and oppositely charged magnetic carrier particles of substantially uniform particle size and substantially spherical shape comprising hard magnetic ferrite material having a single-phase, hexagonal crystalline structure of the formula:

$$MO \bullet (Fe_2O_3)_x \text{ (A)}$$

where M is strontium or barium and x is 5 to 6, said carrier particles having been produced by:

(i) mixing an aqueous solution containing strontium ions and iron (III) ions or barium ions and iron (III) ions in amounts sufficient to provide the strontium ferrite or barium ferrite of formula (A);

(ii) reacting the mixture formed in step (i) with an alkaline aqueous ammonium hydroxide solution having an alkalinity of at least 0.1N to form finely-divided co-precipitated particles of strontium hydroxide and iron (III) hydroxide or barium hydroxide and iron (III) hydroxide;

(iii) separating the co-precipitated particles from the aqueous mother liquor;

(iv) washing the resultant co-precipitated particles;

(v) mixing the washed co-precipitated particles obtained from step (iv) with an organic binder and water, as a solvent, to form a slurry;

(vi) spray drying the slurry to obtain green beads of substantially uniform particle size and substantially spherical shape, and (vii) firing the beads at a temperature ranging from approximately 900° to 1100° C. for a period of time of from approximately 7 to 10 hours to obtain magnetic carrier particles of substantially uniform particle size and substantially spherical shape comprising hard magnetic ferrite material having a single-phase, hexagonal crystalline structure of the formula:

$$MO \bullet (Fe_2O_3)_x \text{ (A)}$$

where M is strontium or barium and x is 5 to 6.

A method of developing an electrostatic charge pattern on a surface also is contemplated utilizing the electrographic two-component developer mix of the present invention.

DESCRIPTION OF THE PREFERRED EMBODIMENTS

In this invention, an alkaline aqueous ammonium hydroxide solution having an alkalinity of at least 0.1N or more and containing strontium ions and iron (III) ions or barium ions and iron (III) ions in amounts sufficient to provide a single-phase, hexagonal crystalline strontium ferrite or barium ferrite of the general formula:

$$MO \bullet (Fe_2O_3)_x \text{ (A)}$$

where M is barium or strontium and x is 5 to 6 is formed.

Although any suitable method can be employed for preparing the alkaline aqueous ammonium hydroxide solution mentioned above, it is convenient first to prepare separate aqueous solutions each containing a desired metal compound, followed by mixing the aqueous solutions prepared first and subsequently adding the mixture to the strong alkaline aqueous solution containing a prescribed amount of ammonium hydroxide. The metal ions contained in the aqueous solution are supplied by water-soluble compounds of the corresponding metals. Typically, the water-soluble compounds of strontium chloride, barium chloride and iron (III) chloride are employed. Thus, if strontium chloride and iron (III) chloride are used as starting materials, an aqueous solution of strontium chloride and a separate aqueous solution of iron (III) chloride are mixed together to form an aqueous solution containing strontium ions and iron (III) ions. The amounts of strontium chloride and iron (III) chloride is chosen so that the ratio of iron (III) ions to strontium ions is from 10:1 to 12:1.

The concentration of ammonium hydroxide in the alkaline aqueous solution should be at least 0.01N in order to insure that the alkaline aqueous solution has a pH value of at least 10. A pH value of at least 10 is required to effect the rapid co-precipitation of the individual metal hydroxides from the solution. As the pH value of the solution progressively decreases below 10, the rate of precipitation also progressively decreases and the size of the particles which precipitate from the solution become progressively larger. It is desirable to obtain co-precipitated particles having a small particle size, typically from 0.05 to 0.5 micrometers, in order to achieve optimal mixing of the particles with the binder and to avoid high settling rates in the subsequently formed slurry. As long as the pH value of the solution is maintained at 10 or more, the desired small particle size will be achieved. Preferably, the alkaline compound, i.e., ammonium hydroxide, should be contained in the solution at a concentration of 1 to 7N.

In general, it is usually desirable to cool the mixture of the metal compound solutions to about 10° C. or less before the mixture is added to the alkaline aqueous solution. This is done to retard or suppress the rate at which the iron (III) hydroxide precipitates from the solution so that a true co-precipitate of iron (III) hydroxide and strontium hydroxide or iron (III) hydroxide and barium hydroxide can be precipitated from the solution in as much as iron (III) hydroxide will inherently precipitate from the solution at a faster rate than either strontium hydroxide or barium hydroxide due to the higher reaction kinetics of ferric hydroxide formation unless some method, such as cooling, is utilized to slow the rate of precipitation of the iron (III) hydroxide from the solution.

In addition, it may also be desirable to add to the alkaline aqueous solution a precipitating agent such as ammonium carbonate in an amount sufficient to increase the rate of precipitation of the strontium hydroxide or barium hydroxide from the aqueous solution over its normal rate of precipitation therefrom in order to effect the co-precipitation of iron (III) hydroxide and strontium hydroxide or iron (III) hydroxide and barium hydroxide from the solution at the same rate so that a true co-precipitate is formed. This insures that the stoichiometry, i.e. the ratio of metal ions contained in the alkaline aqueous solution is maintained or preserved in the final crystalline barium or strontium ferrite material. The exact amount of ammonium carbonate to be added to the alkaline aqueous solution generally will depend on the pH value of the alkaline aqueous solution, the concentration of the starting reactants and the temperature of the alkaline aqueous solution. Such amounts can readily and easily be determined by one skilled in the art. In general, however, an amount of ammonium carbonate in the range of from about 5 to 15 times the amount of strontium or barium ions present in the alkaline aqueous solution on a weight basis has been found to be a suitable amount.

The co-precipitate formed after the combination of the solutions is wholly amorphous, i.e., without a definite crystalline symmetry and consists of finely-divided particles of co-precipitated iron (III) hydroxide and strontium hydroxide or iron (III) hydroxide and barium hydroxide having a particle size of approximately 0.01 to 0.5 micrometers. As mentioned previously, chemical bonds, believed to be hydrogen bonds, are formed among the co-precipitates at the molecular level which creates such a high degree of intimacy between the iron (III) cations and the strontium or barium cations in the co-precipitates that the formation of undesirable by-products such as the aforementioned strontium oxide, barium oxide and/or iron (III) oxide is prevented from taking place so that the carrier particles of the present invention made from such single-phase hexagonal crystalline strontium and barium ferrite materials also are free or substantially free of such contaminants and do not suffer a reduction in charging capabilities as a result of the presence of such contaminants in the carrier particles.

Following precipitation, the co-precipitate is removed from the mother liquor or liquid portion of the reactants by suitable means, such as, for example, by filtering, centrifuging, decanting and the like. Any ammonium carbonate present will remain in the filtrate and can readily and easily be disposed of after separation by conventional means such as vacuum suction. The co-precipitate, so recovered, is water-washed to remove any ammonium chloride residue from the co-precipitate formed as a by-product of the co-precipitation process. Any such residue which may still be present after water-washing will ultimately be decomposed during the subsequent firing step and thus will not be present in the resultant carrier particles where they could interfere with or adversely affect the magnetic properties of the carrier particles.

After washing, the co-precipitate, typically while still wet, is mixed with an organic binder, such as guar gum and water, as a solvent, to form a slurry, which is then spray dried to form green beads of substantially uniform particles size and substantially spherical shape. The green beads are then fired at a temperature ranging from approximately 900° C. to 1100° C. for a period of time or from approximately 7 to 10 hours to obtain magnetic carrier particles of substantially uniform particle size and substantially spherical shape comprising hard magnetic strontium or barium ferrite material devoid or substantially devoid of any contaminants consisting of barium oxide, strontium oxide, and/or iron (III) oxide.

Generally, the aqueous slurry formed as described above will comprise from about 30 to 70 percent by weight, typically 50 percent by weight, of the co-precipitate and from approximately 2.0 to 6.0 percent by weight, typically 4.0 percent by weight, organic binder, based on the total weight of the slurry.

A spray dryer designed for either spray nozzle atomization of spray machine-disc atomization or equivalent may be employed to dry the slurry of ferrite-forming starting materials. A particularly desirable type of spray machine is one that is essentially a closed pump impeller driven by a variable speed drive and is commonly termed a spinning atomizer, disc or wheel. A Niro Atomizer or Niro Spray Dryer (disc type) is especially useful. The total system generally consists of a power-coolant-lubrication console, power cables, fluid transport hoses, and a variable speed motor drive with closed impeller. The high speed impeller uses the energy of centrifugal force to atomize the slurry. The particle size distribution obtained with this spray machine is generally narrow. Preferably, when employing the spinning atomizer, the spray dryer should have a large diameter configuration to avoid sticking of the atomized ferrite-forming precursor particles to the dryer chamber walls. Slurries of ferrite-forming particles may be atomized using two-fluid nozzles where the atomizing force is pressured air, single-fluid pressure nozzles where the atomizing force is the pressure of the slurry itself released through an orifice, and centrifugal atomization by spinning wheel or other suitable atomization method. The atomizing pressures, or the speed of rotation in the case of wheel atomization, and the slurry feed rates may be varied as a partial control of particle size. It is also possible to control the particle size of the spray dried ferrite-forming beads by varying the percentage of solids in the feed slurry. The atomizing force and feed rate should be adjusted to the configuration, size and volumetric air flow of a given drying chamber in order that atomized particles do not contact drying chamber surfaces while still wet. In accordance with the present invention, the percentage of solids in the feed slurry may be varied from about 30 to about 70 percent by weight of the ferrite-forming precursor materials slurried in the liquid medium. As previously mentioned, the ferrite-forming precursor particles produced by the co-precipitation process of the invention have an average particle size of approximately 0.01 to 0.5 micrometer. Such small particle sizes are desirable in order to achieve optimal mixing of the particles with the binder and to avoid high settling rates of the particles in the slurry. The spray dried ferrite-forming beads may be collected in drying chambers of suitable size. Spray dried beads have been collected in a chamber 30 inches in diameter and 5 feet in height, with volumetric air flow of 250 cfm. With a system of this type, a product collection rate of about 30 pounds per hour may be maintained. Both types of dryer systems will produce a spray dried product in the size range for a particular electrostatographic use, for example, on the order of 5 to 500 micrometers. In addition, both co-current and counter-current drying systems yield satisfactory products. The temperature of the drying air may be varied from about 150° to about 200° C. at the inlet and from about 50° to about 100° C. at the outlet with satisfactory results. Atomizing pressures typically range from about 20 to 50 psi.

If desired, binder materials other than guar gum or gum arabic such as polyvinyl alcohol, dextrin, lignosulfonate and methyl cellulose can be used in the practice of the present invention to bind the constituent ferrite-forming materials or particles together after evaporation of the water during spray drying.

It is important that the co-precipitated particles be spray dried in accordance with the process described herein in order to obtain the optimum particle size for the resultant carrier particles produced by the present process and to obtain carrier particles of substantially uniform particle size and uniform spherical shape. A uniform particle size is desirable in order to achieve uniform charging of the toner particles and substantially spherical shaped particles are desirable in order to achieve optimal charging levels on the toner particles.

As a result of the co-precipitation process of the present invention, the ratio or proportion of iron and strontium or iron and barium in the co-precipitated particles produced by the process of the present invention is the same as that initially present in the alkaline aqueous solution. Further, this predetermined ratio not only is preserved in the co-precipitated particles produced by the process of the present invention, but also in the green bead particles and the final carrier particles produced by the process of the present invention. Consequently, each of the carrier particles produced in accordance with the instant process will comprise single-phase, hexagonal crystalline strontium or barium ferrite material in substantially pure form uncontaminated by strontium oxide, barium oxide and/or iron (III) oxide and will not exhibit a reduction in charging capability consistent with and characteristic of those strontium ferrite and barium ferrite carrier particles of the prior art made by mechanical mixing methods. As a result, because of the chemical homogenity and purity of the ferrite materials which make-up the carrier particles produced by the method of the present invention, substantially no early life dusting or toner throw-off will be exhibited by the two-component developer compositions comprising the carrier particles of the present invention and oppositely charged toner particles.

Any suitable type of furnace may be employed in the firing step of the process of this invention. Typical sintering furnaces include a static furnace, a rotary kiln, or an agitated bed furnace. The static furnace type will generally provide for long residence times. The rotary kiln type of furnace generally provides uniform product reaction, consistent residence time and high capacity throughput. When employing a rotary kiln furnace, a special media such as a flow promoting ingredient, for example, aluminum oxide, zirconium oxide, or other materials may be added in combination with the ferrite-forming precursor beads to minimize or avoid bead-to-bead agglomeration and bead to furnace wall sticking. Preferably, the flow promoting ingredient is approximately the same size as the spray dried beads because bead-to-bead agglomeration and bead to furnace wall sticking is substantially eliminated. Thus, if the spray dried beads are about 100 microns, the flow promoting ingredient should also be about 100 microns. In addition, to further avoid or minimize bead sticking to rotary furnace walls a scraping device may be employed individually or in combination with the flow promoting ingredient. In any event, the firing of the ferrite-forming beads should be under controlled conditions so as to preserve the shape and particulate nature of the beads while providing a uniform furnace residence time to produce maximum bead uniformity and desired properties.

Firing of the ferrite-forming spray dried beads at elevated temperatures to induce reaction of the ferrite-forming components is carried out at temperatures of from approximately 900° C. to 1100° C. for a period of time of approximately 7 to 10 hours. Temperatures somewhat below 900° C. will lead to an incomplete reaction resulting in the formation of unwanted strontium oxide, barium oxide and/or iron (III) oxide contaminants in the resultant carrier particles and temperatures in excess of approximately 1100° C., on the other hand, will result in the formation of non-spherical particles.

Any suitable size of furnace may be employed in the firing step of the process of this invention. Static furnaces are preferred because they generally provide a consistent residence time, uniformity of product reaction, and high capacity throughput.

The magnetic carrier particles produced by the method of this invention comprise strontium or barium ferrite material which exhibit a coercivity of at least 300 Oersteds when magnetically saturated, preferably a coercivity of at least 500 Oersteds and most preferably a coercivity of at least 1000 to 4000 Oersteds.

In addition to the coercivity values exhibited by the carrier particles produced by the method of the present invention, the carrier particles of this invention exhibit an induced magnetic moment of at least 20 EMU/g, based on the weight of the carrier. Preferably, the induced magnetic moment of the present carriers is at least 25 EMU/g and more preferably from about 30 to about 60 EMU/g.

Thus, the carrier particles produced by the method of the present invention possess the high magnetic properties required to develop electrostatic charge patterns at high volume copying speeds when employed in electrostatographic development processes and to produce developed toner images of extremely high quality.

The coercivity of a magnetic material refers to the minimum external magnetic force necessary to reduce the induced magnetic moment, M, from the remnance value, Br, to zero while it is held stationary in the external field, and after the material has been magnetically saturated, i.e., the material has been permanently magnetized. A variety of apparatus and methods for the measurement of the coercivity of the present carrier particles can be employed. For the present invention, a Princeton Applied Research Model 155 Vibrating Sample Magnometer, available from Princeton Applied Research Company, Princeton, N.J., was used to measure the coercivity of particle samples. The powder was mixed with a non-magnetic polymer powder (90% magnetic powder: 10% polymer by weight). The mixture was placed in a capillary tube, heated above the melting point of the polymer and then allowed to cool to room temperature. The filled capillary tube was then placed in the sample holder of the magnometer and a magnetic hysteresis loop of external field (in Oersteds) versus induced magnetism (in EMU/g) was plotted. During this measurement, the sample was exposed to an external field of 0 to 10,000 Oersteds.

The magnetic carrier particles produced by the method of this invention are combined with powdered toner particles to form two-component developer compositions that have a much reduced tendency toward early life dusting.

In use, the toner particles are electrostatically attracted to the electrostatic charge pattern on an element while the carrier particles remain on the applicator shell or sleeve. This is accomplished in part by intermixing the toner and carrier particles so that the carrier particles acquire a charge of one polarity and the toner particles acquire a charge of the opposite polarity. The charge polarity on the carrier is such that it will not be electrically attracted to the electrostatic charge pattern. The carrier particles also are prevented from depositing on the electrostatic charge pattern because the magnetic attraction exerted between the rotating core and the carrier particles exceeds the electrostatic attraction which may arise between the carrier particles and the charge image.

Tribocharging of toner and hard magnetic carrier is achieved by selecting materials that are so positioned in the triboelectric series to give the desired polarity and magnitude of charge when the toner and carrier particles intermix. If the carrier particles do not charge as desired with the toner employed, the carrier can be resin-coated with a material which does.

The resin with which the carrier particles can be coated can be any of a large class of thermoplastic polymeric resins. Especially desirable are fluorocarbon polymers such as poly(vinylidene fluoride) and poly(vinylidene fluoride-co-tetra-fluoroethylene). Also useful are the copolymers of vinylidene chloride with acrylic monomers which are disclosed in U.S. Pat. No. 3,795,617. Other examples include cellulose esters such as cellulose acetate and cellulose acetate butyrate, polyesters such as poly(ethylene terephthalate) and poly(1,4-butanediol terephthalate), polyamides such as nylon and polycarbonates, polyacrylates and polymethacrylates. Still other examples include the thermosetting resins and light-hardening resins described in U.S. Pat. No. 3,632,512; the alkali-soluble carboxylated polymers of U.S. Pat. No. Re. 27,912 (Reissue of U.S. Pat. No. 3,547,822); and the ionic copolymers of U.S. Pat Nos. 3,795,618 and 3,898,170.

The ferrite carrier particles used in two-component developers normally are of larger size than the toner particles. They have, for example, an average diameter from 5 to 500 micrometers, preferably from 5 to 100 micrometers and most preferably, 5 to 60 micrometers.

In coating the ferrite carrier particles with resin, the carrier particles are mixed with finely-divided powdered resin. The particle size of the powdered resin can vary considerably but should be smaller than the particle size of the carrier particles. The resin particles can range in average diameter from 0.01 to 50 micrometers although a particle size from 0.05 to 10 micrometers is preferred.

The amount of resin powder relative to the amount of carrier particles can vary over a considerable range, but preferably, is from 0.05 to 5 weight percent. By using such a small amount of resin it is possible to form a discontinuous resin coating or a very thin resin coating on the ferrite particles and retain good conductivity in accordance with the invention.

To dry-mix the carrier particles and resin particles, they preferably are tumbled together in a rotating vessel. This dry mixing should continue preferably for several minutes, e.g., for 5 to 30 minutes. Other methods of agitation of the particles are also suitable, e.g., mixing in a fluidized bed with an inert gas stream, or mixing by a mechanical stirrer.

After dry mixing the carrier particles and resin powder as described, the resin is bonded to the carrier particles, for example, by heating the mixture in an oven at a temperature and for a time sufficient to achieve bonding.

The charging level in the toner is at least 5 microcoulombs per gram of toner weight. Charging levels from about 10 to 30 microcoulombs per gram of toner are preferred, while charging levels up to about 150 microcoulombs per gram of toner are also useful. At such charging levels, the electrostatic force of attraction between toner particles and carrier particles is sufficient to disrupt the magnetic attractive forces between carrier particles, thus facilitating replenishment of the developer with fresh toner. How these charging levels are measured is described immediately below. The polarity of the toner charge can be either positive or negative.

The charge level or the charge-to-mass ratio on the toner, Q/M, in microcoulombs/gram, is measured using a standard procedure in which the toner and carrier are placed on a horizontal electrode beneath a second horizontal electrode and are subjected to both an AC magnetic field and a DC electric field. When the toner jumps to the other electrode change in the electric charge is measured and is divided by the weight of toner that jumped. It will be appreciated, in this regard, that the carrier will bear about the same charge as, but opposite in polarity to, that of the toner.

The developer is formed by mixing the particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 percent carrier and from about 25 to 1 weight percent toner.

The toner component of the invention can be a powdered resin which is optionally colored. It normally is prepared by compounding a resin with a colorant, i.e., a dye or pigment, and any other desired addenda. If a developed image of low opacity is desired, no colorant need be added. Normally, however, a colorant is included and it can, in principle, be any of the materials mentioned in Colour Index, Vols. I and II, 2Nd Edition. Carbon black is especially useful. The amount of colorant can vary over a wide range, e.g., from 3 to 20 weight percent of the polymer. Combinations of colorants may be used.

The mixture is heated and milled to disperse the colorant and other addenda in the resin. The mass is cooled, crushed into lumps and finely ground. The resulting toner particles range in diameter from 0.5 to 25 micrometers with an average size of 1 to 16 micrometers. Preferably, the average particle size ratio of carrier to toner lie within the range from about 15:1 to about 1:1. However, carrier-to-toner average particle size ratios of as high as 50:1 are also useful.

The toner resin can be selected from a wide variety of materials, including both natural and synthetic resins and modified natural resins, as disclosed, for example, in the patent to Kasper et al, U.S. Pat. No. 4,076,857 issued Feb. 28, 1978. Especially useful are the crosslinked polymers disclosed in the patent to Jadwin et al, U.S. Pat. No. 3,938,992 issued Feb. 17, 1976, and the patent to Sadamatsu et al, U.S. Pat. No. 3,941,898 issued Mar. 2, 1976. The crosslinked or noncrosslinked copolymers of styrene or lower alkyl styrenes with acrylic monomers such as alkyl acrylates or methacrylates are particularly useful. Also useful are condensation polymers such as polyesters.

The shape of the toner can be irregular, as in the case of ground toners, or spherical. Spherical particles are obtained by spray drying a solution of the toner resin in a solvent. Alternatively, spherical particles can be prepared by the polymer bead swelling technique disclosed in European Pat. No. 3905 published Sept. 5, 1979, to J. Ugelstad.

The toner can also contain minor components such as charge control agents and antiblocking agents. Especially useful charge control agents are disclosed in U.S. Pat. No. 3,893,935 and British Pat. No. 1,501,065. Quaternary ammonium salt charge agents are disclosed in Research Disclosure, No. 21030, Volume 210, October, 1981 (published by Industrial Opportunities Ltd., Homewell, Havant, Hampshire, P09 IEF, United Kingdom), are also useful.

The following non-limiting examples further illustrate the invention.

EXAMPLE 1

A quantity of 10.66 grams (0.04 mole) of reagent grade $SrCl_2$ was added to 50 milliliters of distilled water in a conical glass flask. In another conical flask, 122.99 grams (0.45 mole) of reagent grade $FeCl_3$ were added to 200 milliliters of distilled water. The two liquid solutions were then stirred together into another flask and the mixture was poured into a dropping funnel. Water was added to the dropping funnel until the final volume of the mixture was 280 milliliters. The resultant mixture was then introduced (i.e., dropped at a constant rate) into a vessel containing 38.40 grams (0.40 mole) ammonium carbonate and 191.21 grams (5.32 moles) ammonium hydroxide over a period of time of approximately 30 minutes while the temperature of the contents of the vessel was maintained at approximately 10° C. and the aqueous alkaline solution was stirred vigorously. The pH was approximately 11.5. The solution was then filtered to remove a co-precipitate of strontium hydroxide and iron (III) hydroxide and washed several times with distilled water to remove ammonium chloride by-product from the precipitate. In a separate container, a stock solution was prepared by dissolving 4.0 weight percent (based on the total weight of the solution) of a binder resin, i.e., gum arabic into 250 milliliters of distilled water. Next, 100 grams of the wet precipitate obtained previously were added to the stock solution and then spray dried in a Niro Spray Dryer. The spray drying was carried out utilizing the following parameters:

| | |
|---|---|
| Inlet Temperature: | 150–200° C. |
| Outlet Temperature | 60–100° C. |
| Solution Flow: | 20–30 cc/min |
| Speed: | 3000–4000 RPM |
| Atomizing Pressure: | 40–50 psi |

The green beads thus obtained were then fired at 1000° C. for 1 hour, 2.5 hours, 5.0 hours, 7.5 hours and 10 hours to obtain carrier particles comprising single-phase crystalline strontium ferrite particles having a particle size of 10 to 60 micrometers. The strontium ferrite particles were determined by standard means using a Princeton Applied Research Model 155 Vibrating Sample Magnometer to have the following magnetic properties:

| Hours | Magnetic Moment (EMU/g) | Coercivity (Oersted) |
|---|---|---|
| 1 | 54.8 | 4,325 |
| 2.5 | 55.2 | 4,140 |
| 5.0 | 55.5 | 4,030 |
| 7.5 | 55.6 | 3,961 |
| 10.0 | 55.0 | 4,092 |

EXAMPLE 2

The procedure of Example 1 was repeated with the only exception being that 6.0 weight percent of gum arabic was used in the procedure instead of 4.0 weight percent as in Example 1. The strontium ferrite powders produced thereby were determined to have the following magnetic properties:

| Hours | Magnetic Moment (EMU/g) | Coercivity (Oersted) |
|---|---|---|
| 1 | 41.0 | 3,382 |
| 2.5 | 55.8 | 3,280 |
| 5.0 | 56.4 | 3,544 |
| 7.5 | 56.5 | 3,245 |
| 10.0 | 56.5 | 3,145 |

The invention has been described in detail with particular reference to the preferred embodiments thereof, but it will be understood that variations and modifications can be effected within the spirit and scope of the invention.

I claim:

1. A method of producing magnetic carrier particles of substantially uniform particle size and substantially spherical shape comprising hard magnetic ferrite material having a single-phase hexagonal crystalline structure of the formula:

$MO \bullet (Fe_2O_3)_x$ (A)

where M is strontium or barium and x is 5 to 6 suitable for magnetic brush development of electrostatic charge patterns and having a reduced tendency towards early life dusting, which method comprises:

(i) mixing an aqueous solution containing strontium ions and iron (III) ions or barium ions and iron (III) ions in amounts sufficient to provide the strontium ferrite or barium ferrite of formula (A);

(ii) reacting the mixture formed in step (i) with an alkaline aqueous ammonium hydroxide solution having an alkalinity of at least 0.1N to form finely divided co-precipitated particles of strontium hydroxide and iron (III) hydroxide or barium hydroxide and iron (III) hydroxide;

(iii) separating the co-precipitated particles from the aqueous mother liquor;

(iv) washing the resultant co-precipitated particles;

(v) mixing the washed co-precipitated particles obtained from step (iv) with an organic binder and water, as a solvent, to form a slurry;

(vi) spray drying the slurry to obtain green beads of substantially uniform particle size and substantially spherical shape, and (vii) firing the beads at a temperature ranging from approximately 900° C. to 1100° C. for a period of time of from approximately 7 to 10 hours to obtain magnetic carrier particles of substantially uniform particle size and substantially spherical shape comprising hard magnetic ferrite material having a single-phase, hexagonal crystalline structure of the formula:

$MO \bullet (Fe_2O_3)_x$ (A)

where M is strontium or barium and x is 5 to 6.

2. A method according to claim 1, wherein the organic binder is guar gum.

3. A method according to claim 1, further characterized in that ammonium carbonate is present in the alkaline aqueous solution.

4. A method according to claim 3, wherein the ammonium carbonate is present in the alkaline aqueous solution in an amount ranging from approximately 10 to 15 times the amount of strontium ions or barium ions present in the alkaline aqueous solution.

5. A method according to claim 1, wherein the alkaline aqueous solution has an alkalinity of 1 to 7N.

6. A method according to claim 1, wherein the pH value of the alkaline aqueous solution is at least 10.

7. A method according to claim 1, wherein the mixture of step (i) is formed by mixing an aqueous solution of strontium chloride with an aqueous solution of iron (III) chloride.

8. A method according to claim 1, wherein the mixture of step (i) is formed by mixing an aqueous solution of barium chloride with an aqueous solution of iron (III) chloride.

9. A method according to claim 1, wherein the aqueous solution of step (i) is cooled to 10° C. or less and then reacted with the alkaline aqueous ammonium hydroxide solution.

10. A method according to claim 1, wherein the carrier particles exhibit a coercivity of at least 300 Oersteds when magnetically saturated and an induced magnetic moment of at least 20 EMU/g of carrier in an applied magnetic field of 1000 Oersteds.

11. A method according to claim 1, wherein the carrier particles are coated with a polymer comprising a poly(vinylidene fluoride) resin, a polymethacrylate, a polyacrylate or a polyester.

* * * * *